US009843099B2

(12) United States Patent
Legay et al.

(10) Patent No.: US 9,843,099 B2
(45) Date of Patent: Dec. 12, 2017

(54) COMPACT RADIATING ELEMENT HAVING RESONANT CAVITIES

(75) Inventors: Hervé Legay, Plaisance Du (FR); Shoaib Muhammad, Rennes (FR); Ronan Sauleau, Acigne (FR); Gérard Caille, Tournefeille (FR)

(73) Assignees: Thales, Courbevoie (FR); Centre National De La Recherche Scientifique, Paris (FR)

( * ) Notice: Subject to any disclaimer, the term of this patent is extended or adjusted under 35 U.S.C. 154(b) by 923 days.

(21) Appl. No.: 13/695,491

(22) PCT Filed: Apr. 29, 2011

(86) PCT No.: PCT/EP2011/002149

§ 371 (c)(1),
(2), (4) Date: Nov. 9, 2012

(87) PCT Pub. No.: WO2011/134666

PCT Pub. Date: Nov. 3, 2011

(65) Prior Publication Data

US 2013/0207859 A1 Aug. 15, 2013

(30) Foreign Application Priority Data

Apr. 30, 2010 (FR) ..... 10 01863

(51) Int. Cl.
*H01Q 13/02* (2006.01)
*H01Q 13/00* (2006.01)
(Continued)

(52) U.S. Cl.
CPC ..... *H01Q 13/00* (2013.01); *H01Q 1/405* (2013.01); *H01Q 1/528* (2013.01);
(Continued)

(58) Field of Classification Search
CPC ..... H01Q 13/025; H01Q 13/00; H01Q 15/24; H01Q 13/18; H01Q 15/0026;
(Continued)

(56) References Cited

U.S. PATENT DOCUMENTS 4,042,935 A * 8/1977 Ajioka ..... H01Q 13/18 343/795
6,061,027 A 5/2000 Legay et al.
(Continued)

FOREIGN PATENT DOCUMENTS

EP 0014692 A2 * 8/1980 ..... H01P 1/16
FR 2767970 A1 3/1999
(Continued)

OTHER PUBLICATIONS

Muhammad et al. ("Study of Small-Size Stacked Fabry-Perot Cavities for Focal Array Applications". 3rd European Conference on Antennas and Propagation, 2009. EuCAP 2009. pp. 3158-3162. Date of Conference: Mar. 23-27, 2009), in view of Huang et al. US Pub. 20080068275.*

*Primary Examiner* — Dameon E Levi
*Assistant Examiner* — Hasan Islam
(74) *Attorney, Agent, or Firm* — Baker Hostetler LLP

(57) ABSTRACT

A radiating element is provided, for example for array antenna, having stacked resonant cavities of Pérot-Fabry type, of compact structure, a lower cavity being fed by excitation means, the radiating element being characterized in that corrugations are formed substantially below a first earth plane delimiting in its lower part the upper resonant cavity. A radiating element structure of improved compactness is also proposed, whose upper cavity is surmounted by a polarizing radome.

18 Claims, 5 Drawing Sheets

(51) Int. Cl.
*H01Q 1/40* (2006.01)
*H01Q 1/52* (2006.01)
*H01Q 15/24* (2006.01)
*H01Q 15/00* (2006.01)

(52) U.S. Cl.
CPC ..... *H01Q 13/025* (2013.01); *H01Q 15/0026* (2013.01); *H01Q 15/24* (2013.01); *H01Q 15/244* (2013.01)

(58) Field of Classification Search
CPC ..... H01Q 21/064; H01Q 13/0216; H01Q 13/0275; H01P 1/208; H01P 1/171; H01P 1/211
USPC ..... 343/774, 756, 772, 786, 789
See application file for complete search history.

(56) References Cited

U.S. PATENT DOCUMENTS 6,522,306 B1 * 2/2003 Parrikar ..... H01Q 13/0216 333/21 R
6,879,298 B1 * 4/2005 Zarro ..... H01Q 5/47 343/756
2002/0149532 A1 * 10/2002 Wu et al. ..... 343/786
2005/0062663 A1 * 3/2005 Hills ..... H01Q 19/193 343/781 P
2005/0104794 A1 * 5/2005 Rao et al. ..... 343/786
2008/0068275 A1 * 3/2008 Huang et al. ..... 343/786
2009/0058746 A1 * 3/2009 Delgado ..... H01Q 15/0013 343/770
2010/0026606 A1 * 2/2010 Chantalat ..... H01Q 3/46 343/909
2010/0156725 A1 * 6/2010 Legay et al. ..... 343/700 MS
2011/0205136 A1 * 8/2011 Runyon ..... H01Q 13/0216 343/786

FOREIGN PATENT DOCUMENTS

FR 2901062 A1 11/2007
WO 92/16031 A1 9/1992
WO 93/13570 A1 7/1993

* cited by examiner

COMPACT RADIATING ELEMENT HAVING RESONANT CAVITIES

CROSS-REFERENCE TO RELATED APPLICATIONS

This application is a National Stage of International patent application PCT/EP2011/002149, filed on Apr. 29, 2011, which claims priority to foreign French patent application No. FR 1001863, filed on Apr. 30, 2010, the disclosures of which are incorporated by reference in their entirety.

FIELD OF THE INVENTION

The present invention relates to the field of radiating elements, notably for low frequency bands, more particularly frequency bands situated below the S band, said elements being employed in applications which need to radiate power, and also being usable in array antennas. It applies notably to the antennas used in telecommunication satellites.

BACKGROUND

The term "radiating element" designates a combination of at least one radiating earth plane, of excitation means intended to be fed with signals, and of a resonant cavity required to radiate energy representative of these signals according to a chosen wavelength $\lambda_0$.

The radiating elements used in array antennas must typically exhibit at least one of the following characteristics: high surface effectiveness and/or low bulkiness and low mass and/or the capacity to be excited in a compact manner in simple or dual-polarization and/or a bandwidth compatible with the relevant application.

The characteristic of high surface effectiveness is particularly significant when using radiating elements in array antennas, because it makes it possible to optimize the gain and to reduce the levels of the sidelobes and array lobes. Now, as is explained hereinafter, this characteristic is not easily compatible with some of the other characteristics, and notably those of compactness and integration, whatever the frequency band concerned.

The term "array antenna" designates equally well either direct-radiation active array antennas or focal array antennas, the latter having one or more focusing reflector(s), with an array of elementary sources placed in the focal zone. Such an antenna geometry is commonly designated by the initials FAFR corresponding to the conventional terminology "Focal Array Fed Reflector". Within such an antenna, each beam or "spot" is produced by the coherent grouping of the signals of a subset of the elementary sources, with amplitudes and phases suitable for obtaining the desired antenna pattern, notably the size and the direction of aim of the main radiation lobe.

In the low frequency bands, such as for example the L or S band, the radiating elements, whatever the applications for which they are destined, are intended to deputize for overly bulky horns. The most compact horns are of Potter horn type; they have a longitudinal dimension of typically greater than $3\lambda_0$, where $\lambda_0$ is the wavelength in vacuo; for example, $\lambda_0$ is of the order of 150 mm in the S band. These Potter horns are limited in terms of radiating aperture, and therefore in terms of gain. Moreover large dimensions require greater lengths. Consequently, Potter horns exhibit appreciable longitudinal bulkiness, as well as large mass.

Sub-arrays, for example planar in the case of space applications, are also not satisfactory, in terms of losses and compatibility with high-power operation.

A first type of planar sub-array consists of radiating elements of patch type, linked by a triplate distributor. This distributor is relatively complex and does not easily make it possible to produce a sub-array allowing dual-polarization, or indeed dual-band operation. The losses generated in this array may also be appreciable.

A second type of sub-array, notably described in the French patent application published under the reference FR2767970, consists of the combination of an exciter resonator of patch type and of parasitic patches which constitute radiating elements known by the initials ERDV, for "Elément Rayonnant à Directivité Variable" (French for "Variable Directivity Radiating Element"). This second type makes it possible to dispense with the distributor, and therefore to noticeably simplify its definition, as well as to repolarize the fields, circularly, when the patches are chamfered and the polarization is circular. But, its implementation for apertures of greater than 1.5 times the nominal operating wavelength is complex. This concept relies furthermore on a technology of microstrip type which may be incompatible with high powers.

A simplification to the sub-arrays of the second type has been proposed. It consists in replacing, on the one hand, the parasitic patches by a metallic grid producing a semi-reflecting interface facilitating the establishment of the electromagnetic field in the cavity, and on the other hand, the exciter patch by a guided exciter, so as to define a cavity of Pérot-Fabry type, as in the case of an ERDV. The radiating element is then entirely metallic, compatible with applications requiring high power, much simpler to define than a conventional ERDV element, and makes it possible to achieve larger radiating apertures than a conventional ERDV element. However, such a radiating element possesses two drawbacks: the obtaining of radiating apertures of large dimensions requires grids of high reflectivities, so that the electromagnetic field is established in the cavity of Pérot-Fabry type. The use of these high reflectivities generates significant return of the signal to the access guide, and the matching of the radiating element is very tricky and valid only over a very narrow frequency band. Moreover, when high surface effectiveness is required, it is then necessary, in order to insert the radiating element into an array antenna, to constrain the expansion of the electromagnetic field in the cavity, by way of metallic walls. The latter induce a non-uniform distribution of the field in the metallic cavity. Admittedly, the use of grids with variable spacing makes it possible to improve the distribution of the field by causing a more significant reflection in the center than at the periphery, but then the complete structure becomes very difficult to match.

A solution is proposed in the French patent application published under the reference FR2901062. One of the embodiments presented therein, described hereinafter in detail with reference to FIG. 2, comprises a stack of two air cavities of Pérot-Fabry type, allowing great compactness, while conferring high surface efficiency as well as compatibility with signals of high power. The stack of two cavities makes it possible to relax the overvoltage coefficient of the exciter cavity, and to thus reduce the returns in the access, so as to allow better matching. However such a structure is propitious to the excitation of higher modes, notably generated by the discontinuity present at the interface of the two stacked cavities. These higher modes are detrimental to the radiation pattern of the antenna. The aforementioned patent application FR2901062 proposes to alleviate this problem through the use of lateral walls for the cavities, within which appropriate reliefs are produced. The reliefs can for example be produced in the form of longitudinal corrugations. Nonetheless, such corrugations are difficult to produce, and are relatively bulky. Furthermore, it may turn out to be necessary in practice to fill these corrugations with a dielectric, thereby rendering their production more complex, and may generate problems in a space environment, or in an environment in which it is necessary to process signals of high power.

Finally, it is necessary to associate polarization devices with antenna radiating elements. For example, the radiating elements must be able to be excited in simple polarization and/or in dual-polarization and/or in circular polarization. In a typical manner, in antennas comprising radiating elements of horn type, the dimension of the polarizer is of the same order of magnitude as the dimension of the horn. Thus, the bulkiness of the antennas is greatly impacted by the addition of polarizers.

SUMMARY OF THE INVENTION

An aim of the present invention is to alleviate at least the aforementioned drawbacks, by proposing a radiating element having resonant cavities with high surface efficiency, whose structure is particularly compact, and confers an optimal compromise between high surface effectiveness, low bulkiness and low mass, as well as the capacity to be excited in simple polarization or in dual-polarization.

For this purpose, the subject of the present invention is a radiating element comprising at least two concentric resonant cavities, formed by a lower cavity fed by excitation means, and an upper cavity stacked on the lower cavity, each of said resonant cavities being delimited in its lower part by an earth plane, in its lateral part by an essentially cylindrical or conical lateral wall, at least the upper cavity being delimited in its upper part by a first essentially plane cap, the radiating element being characterized in that corrugations essentially of cylindrical shape and concentric with the resonant cavities, are formed substantially below the first earth plane of the upper resonant cavity.

In one embodiment of the invention, the lateral walls may be of essentially cylindrical shape.

In one embodiment of the invention, the lateral walls may be of essentially conical shape.

In one embodiment of the invention, the lower cavity may also be delimited in its upper part, substantially at the level of the lower part of the upper cavity, by a second cap.

In one embodiment of the invention, the earth planes, the caps, the lateral walls and the corrugations may essentially be made of a metallic material.

In one embodiment of the invention, the caps may be formed by a partially reflecting surface.

In one embodiment of the invention, the caps may be formed by a metallic grid.

In one embodiment of the invention, the caps may be formed by a dielectric material.

In one embodiment of the invention, the radiating element may be characterized in that a polarizing radome is produced in the upper part of the upper cavity.

In one embodiment of the invention, the polarizing radome may be formed by two essentially plane frequency-selective polarizing surfaces termed polarizing FSSs, disposed parallel to one another, and parallel to and substantially above said first cap.

In one embodiment of the invention, each polarizing FSS may be formed by a metallic plate comprising a plurality of slots.

In one embodiment of the invention, each polarizing FSS may be formed by a metallic plate comprising a plurality of cross-slot cells.

In one embodiment of the invention, each polarizing FSS may be formed by a metallic plate comprising a plurality of cross-slot cells disposed according to a periodic pattern on the surface of the metallic plate.

In one embodiment of the invention, the lateral walls and the corrugations may be cylindrical with circular cross section.

In one embodiment of the invention, said excitation means may comprise at least one feed guide concentric with the resonant cavities and emerging directly, or via matching means, in the lower cavity.

In one embodiment of the invention, said excitation means may comprise at least one dual feed formed by two lateral waveguides emerging in a symmetric manner with respect to the main axis of the lower cavity, substantially at the level of the lateral wall of the lower cavity, the signals conveyed by the excitation means being tuned phase-wise in such a way that the undesirable higher modes are filtered.

In one embodiment of the invention, said excitation means may comprise at least one feed guide concentric with the resonant cavities and emerging directly, or via matching means, in the lower cavity, and at least one dual feed formed by two lateral waveguides emerging in a symmetric manner with respect to the main axis of the lower cavity, substantially at the level of the lateral wall of the lower cavity, the signals conveyed by the excitation means being tuned phase-wise in such a way that the undesirable higher modes are filtered.

In one embodiment of the invention, a polarizing radome may be produced above the upper cavity, the polarizing radome being essentially of cylindrical shape and concentric with the resonant cavities.

In one embodiment of the invention, the polarizing radome may be essentially of cylindrical shape with square cross section.

The subject of the present invention is also an array antenna characterized in that it comprises a or a plurality of radiating elements such as described hereinabove.

BRIEF DESCRIPTION OF THE DRAWINGS

Other characteristics and advantages of the invention will become apparent on reading the description, given by way of example, offered with regard to the appended drawings which represent.

DETAILED DESCRIPTION

Figure 1:
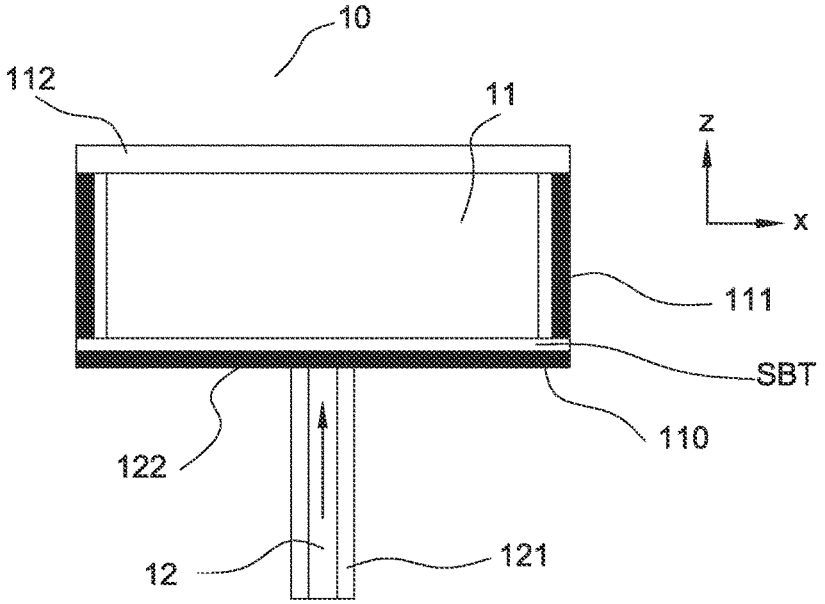
Prior Art FIG.1
FIG. 1, a radiating element with single air cavity, of structure in itself known from the prior art.

FIG. 1 presents a radiating element with single air cavity, of Pérot-Fabry type, according to one embodiment in itself known from the prior art and described in the aforementioned patent application FR2901062.

A radiating element 10, presented in lateral sectional view in a plane XZ in the figure, can comprise a resonant air cavity 11 entirely delimited in its lower part by an earth plane 110 situated in a plane XY, lateral walls 111 and a cap 112 in its upper part. The radiating element 10 comprises excitation means 12, that can be fed with radiofrequency signals. The excitation means 12 can notably comprise a feed access, for example formed by a metallic waveguide 121 whose main axis is parallel to the axis Z, one of the ends of which emerges substantially at the level of the earth plane 110.

The resonant air cavity 11 exhibits a cross section, that is to say parallel to the plane XY, for example of square, circular, hexagonal shape, or else of any other shape which is compatible with placing the radiating element 10 in an array.

In the exemplary embodiment illustrated by FIG. 1, the lateral walls 111 may be of "hard surface" type, that is to say for example made of a metallic material, in which are formed longitudinal furrows disposed on either side of longitudinal ribs. The longitudinal furrows may be at least partially filled with a dielectric material. The longitudinal furrows and the ribs can define a periodic longitudinal structuring. As is previously mentioned, such a structuring is difficult to produce in practice, and exhibits significant bulkiness. Furthermore the production of such a structuring is made complicated by the necessity to fill the longitudinal furrows with a dielectric material.

The cap 112 can for example be made of a slender or thick dielectric material. The dielectric material can for example comprise a face in which is formed a metallic grid forming a semi-reflecting surface making it possible to increase the excitation of the resonant air cavity 11 through the signals. The dielectric material can also comprise a face on which a metallic patch or an array of metallic patches is formed, so as to induce a resonance complementary to that of the resonant air cavity 11. Also, the cap 112 may be made of a metallic material in which a metallic grid is formed. The grid formed in the cap 112 can advantageously exhibit a variable spacing in at least one chosen direction.

Figure 2:
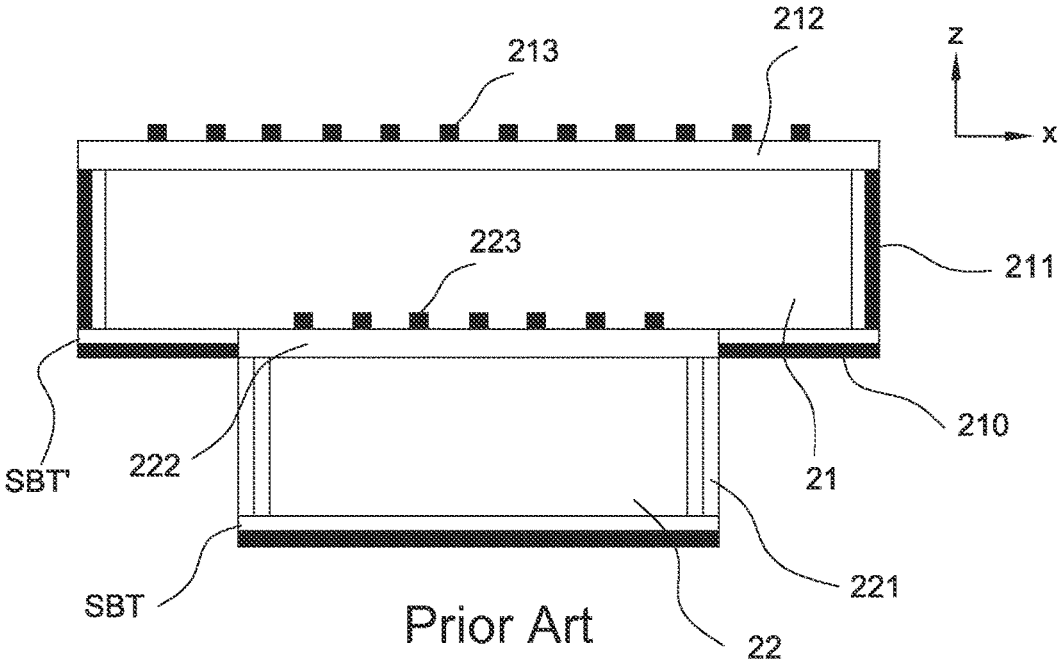
Prior Art FIG.2
FIG. 2, a radiating element with a stack of two air cavities, of structure in itself known from the prior art.

FIG. 2 presents a radiating element with a stack of two air cavities of Pérot-Fabry type, according to one embodiment in itself known from the prior art and described in the aforementioned patent application FR2901062.

A radiating element 20 can comprise two cascaded concentric resonant air cavities 21 and 22; an upper cavity 21 disposed above a lower cavity 22. This cascading makes it possible to excite through the feed access a lower cavity 22 of reduced dimensions, and thus to limit the excitation of higher modes in this lower cavity 22, and then by coupling in the upper cavity 21. The radiation can thus be better controlled, notably in the case of radiating elements 20 of wide apertures. It also makes it possible to reduce the reflectivities of the caps 212 and 222, and therefore to more effectively couple the radiating element 20 to the feed access. Losses by reflection in the access guide are reduced, and thus matching of the input impedance of the radiating element 20 is facilitated.

The upper cavity 21 exhibits substantially the same structure as the lower cavity 22. In a manner similar to the structure with one cavity described previously with reference to FIG. 1, the radiating element 20 comprises excitation means 12, the latter being able to feed the lower cavity 22. The cross section of the upper cavity 21 is greater than that of the lower cavity 22.

The upper cavity 21 is delimited in the plane XY by a first lateral wall 211, and covered in its upper part by a first cap 212. The first lateral wall 211 may be secured to a first earth plane 210, for example formed on the lower surface of a first substrate SBT. In the same manner, the lower cavity 22 is delimited by a second lateral wall 221 and covered by a second cap 222. The second lateral wall 221 may be secured to a second earth plane 220, that can be formed on the lower surface of a second substrate SBT'. The first 212 and the first lateral wall 211 may be produced according to the configuration described previously with reference to FIG. 1. The first substrate SBT and the first earth plane 210 can comprise a through aperture able to house the second cap 222 of the lower cavity 22. As is illustrated by FIG. 2, the caps 212 and 222 can each comprise a metallic grid 213, 223, more generally the latter can comprise partially reflecting surfaces.

The exemplary embodiments of the present invention, described in detail hereinafter with reference to the following figures, apply to a structure comprising at least two stacked resonant cavities, however they may also apply to structures comprising a stack of a plurality of resonant air cavities. The present invention proposes not to resort to the lateral walls of the resonant cavities to alleviate the problems related to the electromagnetic higher modes.

Figure 3A:
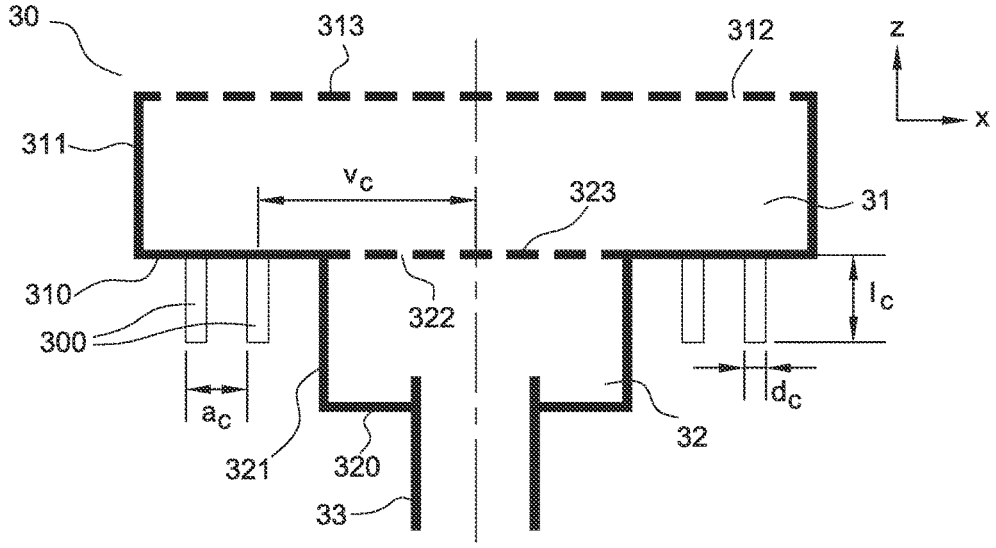
FIGS. 3*a* and 3*b*, a radiating element according to an exemplary embodiment of the invention, respectively in lateral sectional view and top view.
Figure 3B:
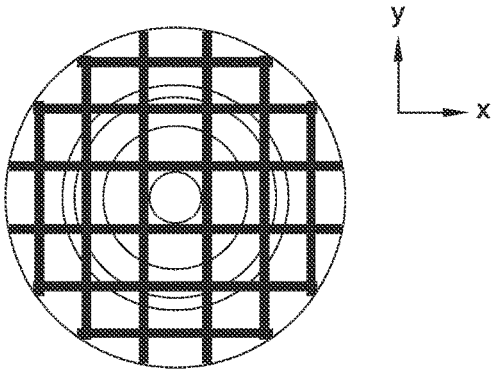

FIGS. 3*a* and 3*b* present a radiating element according to an exemplary embodiment of the invention, respectively in lateral sectional view and top view.

In the example illustrated by FIG. 3*a*, a radiating element 30 presented in section through the plane XZ, can comprise an upper cavity 31 that can be concentric with a lower cavity 32, the upper cavity 31 being stacked on the lower cavity 32, in a manner similar to the example described previously with reference to FIG. 2. It should be noted that the cavities 31, 32 are essentially cylindrical in the embodiments given by way of examples and described by the figures. Alternative embodiments can also comprise cavities 31, 32 of essentially conical shape. The lower cavity 32 may be fed by excitation means, for example a metallic waveguide 33, of cylindrical shape in the example illustrated by the figure. The upper cavity 31 may be delimited in its upper part by a first cap 312, in its lateral part by a first lateral wall 311, and in its lower part by a first earth plane 310. In the same manner, the lower cavity 32 may be delimited in its upper part by a second cap 322, in its lateral part by a second lateral wall 312, and in its lower part by a second earth plane 320. The earth planes 310, 320 can for example be made of a metallic material. Also, the lateral walls 311, 321 may be made of a metallic material, and be devoid of dielectrics and/or of reliefs. An aperture may be produced in the first earth plane 310, of surface area corresponding substantially to the surface area of the lower cavity 32 in the plane XY, said aperture leaving room for the second cap 322. The caps 312, 322 may be formed by partially reflecting surfaces, for example by grids 313, 323. For example for applications requiring radiation according to a single polarization, the grids 313, 323 may be unidimensional grids, such as arrays of wires, the wires being aligned with the excitation polarization. In applications requiring radiation under dual polarization, the grids 313, 323 must have identical reflectivity characteristics for the two excitation polarizations, so they are two-dimensional grids, for which it is not necessary for the alignment to correspond to that of the excitation polarizations.

The waveguide 33 can for example emerge just above the bottom of the lower cavity 32, or else emerge in the lower cavity 32, jutting out slightly from the bottom of the latter. Also, it may be envisaged to resort to matching means, for example irises.

In an alternative embodiment, not represented in the figures, it is also possible to form means of excitation by dual feeds through the side, respectively for applications requiring single polarization or multiple polarization. Also, excitation under dual polarization may be obtained through a feed from below such as described hereinabove, jointly with a dual feed through the side. The dual feeds emerge orthogonally to the lateral surface of the lower cavity 32, and oppositely to one another with respect to the main axis. In these diverse embodiments, each dual feed is associated with a single access for example by means of an appropriate distributor, and all the feeds are excited in a coherent manner, so that the excitations of the undesirable higher modes are filtered. Such structures make it possible to use the radiating element for applications requiring dual polarization.

According to a particular feature of the present invention, corrugations 300 may be formed, substantially below the first earth plane 310. The corrugations 300 may be made of a metallic material, and may be of cylindrical shape, concentric with the resonant cavities 31, 32. In the example illustrated by FIGS. 3*a* and 3*b*, two cylindrical corrugations 300 are represented. In alternative embodiments, a cylindrical corrugation may be envisaged. Also, more than two cylindrical corrugations may be disposed under the upper resonant cavity 31; it may be advantageous in such a case to resort to a plurality of corrugations 300 disposed in a periodic manner, that is to say the separation between two neighboring concentric corrugations remains constant.

In a general manner, it is necessary to resort to a larger number of corrugations 300, if the lateral size of the upper resonant cavity 31 is larger. The position of a corrugation 300 can for example be characterized by its distance $r_C$ with respect to the main axis of the radiating element 30. The dimensioning of the corrugations 300 may be characterized by their height $l_C$, their thickness $d_C$. In the case where several concentric corrugations 300 disposed in a periodic manner are used, the separation between neighboring corrugations may be characterized by the period $a_C$.

The height $l_C$ of the corrugations 300 allows control of the frequency band where the higher mode is removed. It is for example advantageous to choose the height $l_C$ of the order of a quarter of the nominal operating wavelength $\lambda_0$ of the radiating element 30, this value allowing removal of the higher mode.

The position of the corrugations, that is to say the value $r_C$, makes it possible to optimize the axial symmetry of the radiation pattern of the radiating element 30, that is to say the desired similarity between the radiation patterns in the E plane and in the H plane of the radiated electromagnetic wave. It may be advantageous to choose the value $r_C$ of the order of the nominal wavelength $\lambda_0$.

In a typical example, it is for example possible to produce a radiating element 30 intended to operate in a frequency band stretching from 2.48 GHz to 2.5 GHz, whose upper cavity 31 is of cylindrical shape with circular cross section, of a diameter of the order of $2.5\times\lambda_0$, comprising a single cylindrical corrugation 300 with circular cross section, disposed 118 mm from the main axis of the radiating element 30, with a height of 31 mm and a width of 3.7 mm. The diameter of the lower cavity 32 can for example be less than half the diameter of the upper cavity 31. In this typical example, it is of the order of $1\lambda_0$. Such a configuration makes it possible to achieve a perfectly axisymmetric radiation pattern, that is to say, the width of whose lobe is constant whatever the observation plane, and also characterized by a sidelobe level or SLL of less than −20 dB. Furthermore, it possesses performance such as a directivity variation of between 16 dB and 16.2 dB, a variation of the surface effectiveness of between 60% and 63%, a reflection coefficient $|S_{11}|$ of less than −25 dB. By comparison, a radiating element of similar structure not comprising any corrugation is characterized by a non-axisymmetric radiation pattern, with a pinching of the lobe in the E plane associated with an upswing in the sidelobe or SLL, typically between −13 and −10 dB in the operating band.

As is illustrated by FIG. 3*b*, the cavities 31, 32, as well as the corrugations 300 may be cylindrical of circular cross section. Other embodiments of the invention, which are not represented in the figures, can for example comprise cavities 31, 32 and/or cylindrical corrugations 300 of non-circular cross section, for example of square, rectangular, hexagonal, cross section etc.

The reflectivities of the partially reflecting surfaces 313, 323 formed by the caps 312, 322 of the cavities 31, 32 may be adjusted so as to obtain concomitant matching and radiation bands. The lower cavity 32 may be chosen to be of smaller dimension than the upper cavity 31. For example, the partially reflecting surfaces 313, 323 may be formed by grids, and the reflectivity of the grid associated with the lower cavity 32 may be of low value, with the aim of obtaining good matching. The reflectivity of the upper cavity 31 may be of higher value, with the aim of spreading the field over the aperture of the radiating element, and of achieving high directivities.

Values may be given here by way of nonlimiting exemplary embodiment of the invention: it is for example possible to produce a Ku band radiating element 30 of simple linear polarization, with corrugation 300, intended to operate in a frequency band stretching from 11.8 to 13.2 GHz, whose aperture is of the order of $1.85\times\lambda_0$, whose thickness, that is to say the aggregated thickness of the two resonant cavities 31, 32, is of the order of $\lambda_0$, whose caps 312, 322 are respectively formed by semi-reflecting grids of reflectivity coefficients (in terms of power) equal to 20% and to 30% respectively. Such a configuration makes it possible to achieve an axisymmetric radiation pattern characterized by a sidelobe level or SLL of less than −18 dB. Furthermore, it possesses performance such as a directivity variation of between 14.59 dB and 15.39 dB, a variation of the surface effectiveness of between 71.9% and 77.6%, as well as a reflection coefficient $|S_{11}|$ of less than −15.5 dB. By comparison, a radiating element of similar structure not comprising any corrugation is different mainly in that the radiation pattern is non-axisymmetric, and is characterized by a pinching of the lobe in the E plane associated with an upswing in the sidelobe or SLL, typically between −13 and −10 dB in the operating band.

Figure 4:
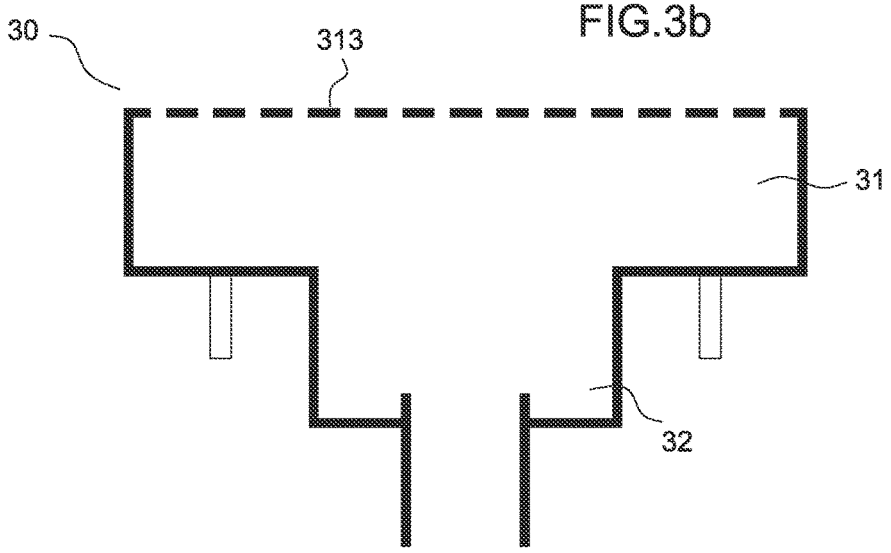
FIG. 4, a radiating element according to another exemplary embodiment of the invention, in a lateral sectional view.

FIG. 4 presents a radiating element according to another exemplary embodiment of the invention, in a lateral sectional view. In the exemplary embodiment illustrated by FIG. 4, a radiating element 30 may be produced according to a structure identical to the structure described hereinabove with reference to FIGS. 3*a* and 3*b*, but in which the lower cavity 32 does not comprise any cap. A radiating element structure such as this comprises only a single grid 313, and hence is simpler and less expensive to produce. The removal of the grid in the lower cavity 32 is indeed possible since the sole abrupt transition between the lower cavity 32 and the upper cavity 31 generates a reflection phenomenon, a lower resonant cavity then being defined without a metallic grid being necessary. Such a structure is for example appropriate for apertures of the radiating element ranging from 1 to $3\lambda_0$, for example for applications in the S or Ku bands, the configuration being given previously by way of example corresponding to an application in the Ku band.

Figure 5:
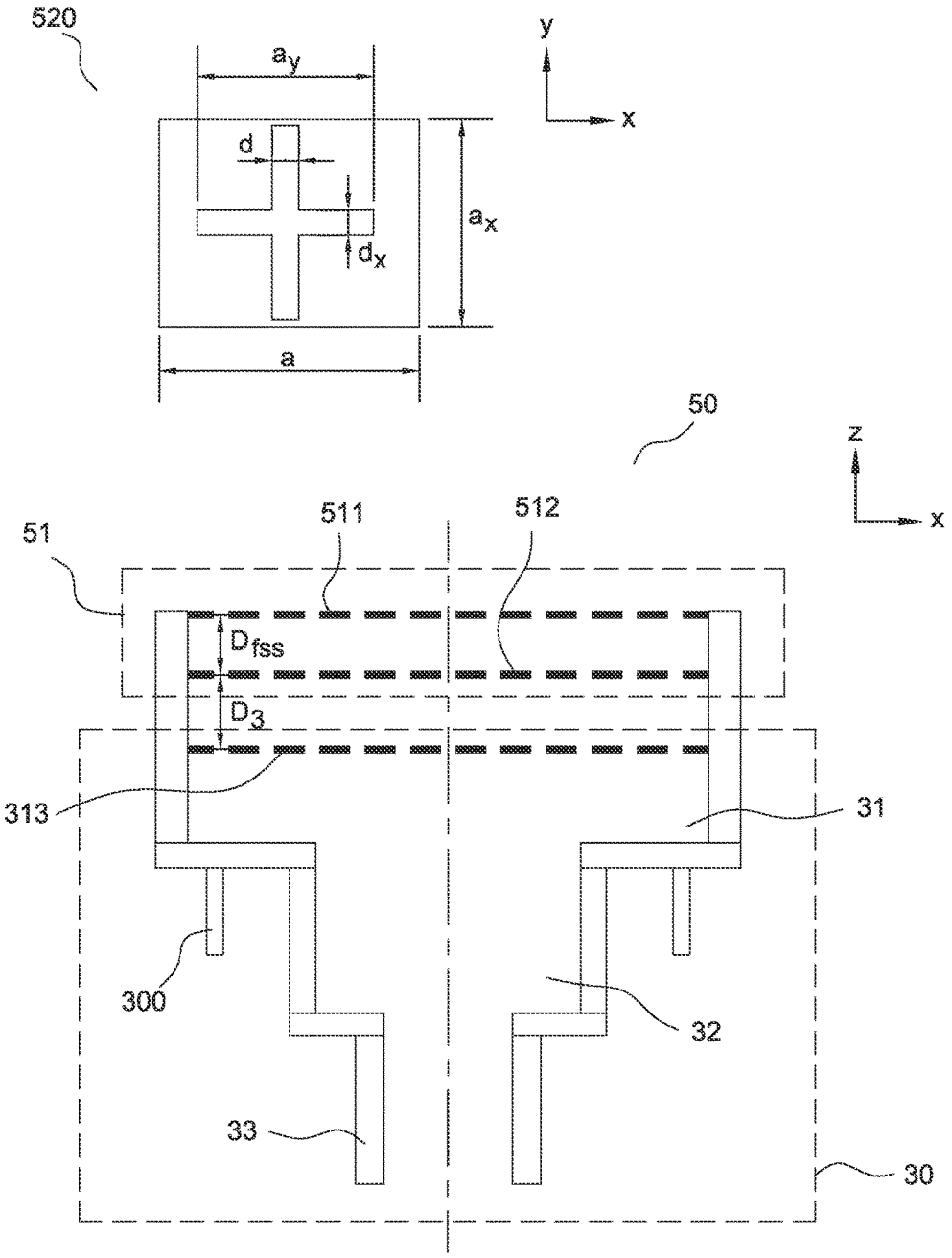
FIG. 5, a radiating element according to another exemplary embodiment of the invention, in a lateral sectional view.

As is previously mentioned, it is advantageously possible to confer greater compactness on a radiating element according to the invention by dispensing with the extra bulkiness imposed by a polarization device or polarizer. FIG. 5 presents an advantageous exemplary embodiment, in which a polarizer is integrated into the actual structure of the radiating element.

With reference to FIG. 5, a radiating element 50 represented in a lateral sectional view in a plane XZ, may be produced according to a structure similar to the structures of the radiating element 30 that were described previously with reference to FIGS. 3*a*, 3*b* and 4. In the example illustrated by FIG. 5, a structure similar to the structure illustrated by FIG. 4 is chosen. The radiating element 50 thus comprises notably a lower cavity 32 fed by excitation means formed by a waveguide 33. The upper cavity 31 is covered by a cap formed by a grid 313 constituting a partially reflecting surface. In the example illustrated by the figure, a simple corrugation is produced substantially under the upper cavity 31. According to a particular feature of the embodiment illustrated by FIG. 5, a polarizing radome 51 may be produced in the upper part of the upper cavity 31. The polarizing radome 51 may be formed by the association of at least two frequency-selective polarizing surfaces, designated polarizing FSS according to the conventional terminology for "Frequency Selective Surface". A polarizing radome is in itself known from the prior art, and makes it possible to induce a phase difference between the two components of the electric field $E_x$ and $E_y$ of the electromagnetic wave. When this phase difference is ±90°, the polarizing radome 51, excited under linear polarization in an oblique direction in the plane XY, that is to say at +45° with respect to the axis X, generates a right circular polarization, and excited under linear polarization in a direction of −45°, generates a left circular polarization. It should be observed that the polarizing radome 51 transforms operation of dual linear polarization type into operation of dual circular polarization type.

In the nonlimiting example illustrated by FIG. 5, the polarizing radome 51 may be of "dual-FSS" type, and comprise two polarizing FSSs 511 and 512 disposed in parallel one above the other, and separated by a distance $D_{Fss}$. The lower FSS 512 is disposed parallel to the grid 313, at a distance $D_3$ from the latter. A configuration of dual FSS type allows a wider bandwidth to be obtained, and lossless signal transmission, the transmission of the signal not inducing a return to the upper cavity 31. It is not possible to obtain with a single-layer polarizing radome, lossless transmission, and a phase shift of 90° along the two components $E_x$ and $E_y$ of the incident signal.

In a typical manner, the two polarizing FSSs 511 and 512 are identical and separated by half a guided wavelength, with the aim of simultaneously obtaining a lossless transmission of the incident signal, and a delay in phase quadrature between the two orthogonal components of the signal transmitted. The polarizing radome 51 is positioned above the radiating element 50 designed to radiate under dual linear polarization, at a distance typically of the order of a quarter of a guided wavelength. Thus, the polarizing radome 51 does not fundamentally disturb the operation of the radiating element 50. A slight modification of the dimensions of the patterns of the FSS may be adjusted with the aim of refining the radiation and the matching of the radiating element 50.

The polarizing FSSs may be of inductive or capacitive type: polarizing FSSs of inductive type being essentially formed by metallic surfaces in which patterns defined by slots are produced, polarizing FSSs of capacitive type being essentially formed by surfaces on which metallic patterns are produced. The use of FSSs of inductive type may turn out to be advantageous, since it does not require the use of a substrate, it then being possible for the FSSs to be made directly of a metallic material.

Each polarizing FSS 511, 512 can for example be produced in the form of a metallic plate furnished with slots. For example, for applications requiring excitation under dual-polarization or under circular polarization, cross-slot cells 520, may be disposed on the metallic plate, for example according to a periodic pattern. A cross-slot cell 520 is represented viewed from above in FIG. 5. The cross-slot cell 520 is notably characterized by the length of its side, or period a, by the length and the width, respectively $a_y$ and $d_y$ of the horizontal slot (that is to say along the X axis), as well as by the length and the width $a_x$ and $d_x$ of the vertical slot (along the Y axis). It is possible to obtain a phase difference between the two field components $E_x$ and $E_y$ by choosing horizontal and vertical slots of different sizes. The reflectivity according to a given polarization is adjusted by varying the length of the slot perpendicular to this polarization. Knowing that the reflectivity of the slot is zero at resonance, and that before its resonance the slot exhibits a reflection coefficient of negative phase and after resonance a positive phase, the cross-slots have different lengths according to each of the two polarizations so as to create a phase shift of 90° between the two polarizations, and thus generate a circular polarization. For example, the lengths $a_x$ and $a_y$ of the slots may be determined so that one of the slots has an action on frequencies lower than the resonant frequency, and the other slot for higher frequencies. In this way, it is possible to obtain for the polarizing radome consisting of two FSSs separated for example by a distance $D_{Fss}$ equal to $\lambda_0/2$ or nearly this value, a phase difference of 90° in transmission between the components $E_x$ and $E_y$. For example, it is possible to fix the length $a_x$ of the vertical slot at a value of less than $\lambda_0/2$, and the length $a_y$ of the horizontal slot at a value of greater than $\lambda_0/2$. It is of course reciprocally possible to fix the length $a_y$ of the horizontal slot at a value of less than $\lambda_0/2$, and the length $a_x$ of the vertical slot at a value of greater than $\lambda_0/2$. The period a must be fixed at a value greater than $a_x$ and than $a_y$. The slot widths $d_x$ and $d_y$ are adjusted as a function of the thickness of the metallic plate. In a typical manner, the widths of the slots $d_x$ and $d_y$ are chosen to be much less than the nominal wavelength $\lambda_0$. The aforementioned exemplary embodiment is based on cross-slot cells 520 arranged according to a square mesh, but it is also possible to resort to cells arranged according to a different mesh, for example round, hexagonal, etc.

Also, patterns other than crosses may be used, for example annular slots, or slots of Jerusalem Cross type, etc.

Figure 6A:
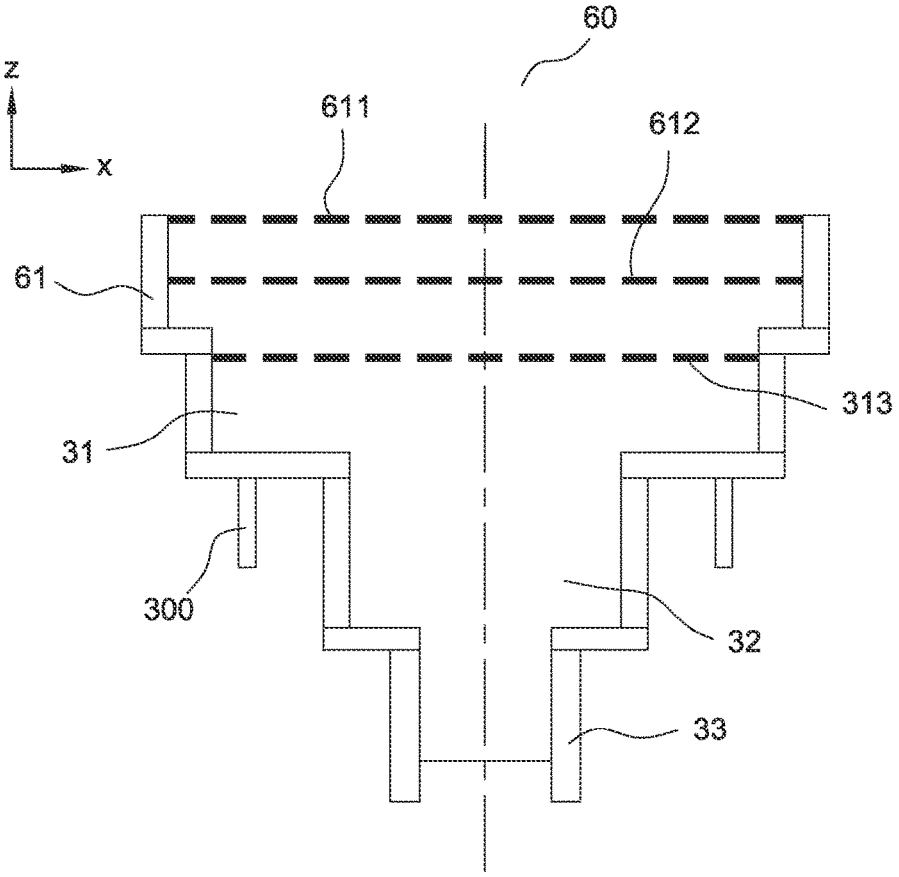
FIGS. 6*a* and 6*b*, a radiating element according to another exemplary embodiment of the invention, respectively in a lateral sectional view, and in a perspective view.
Figure 6B:
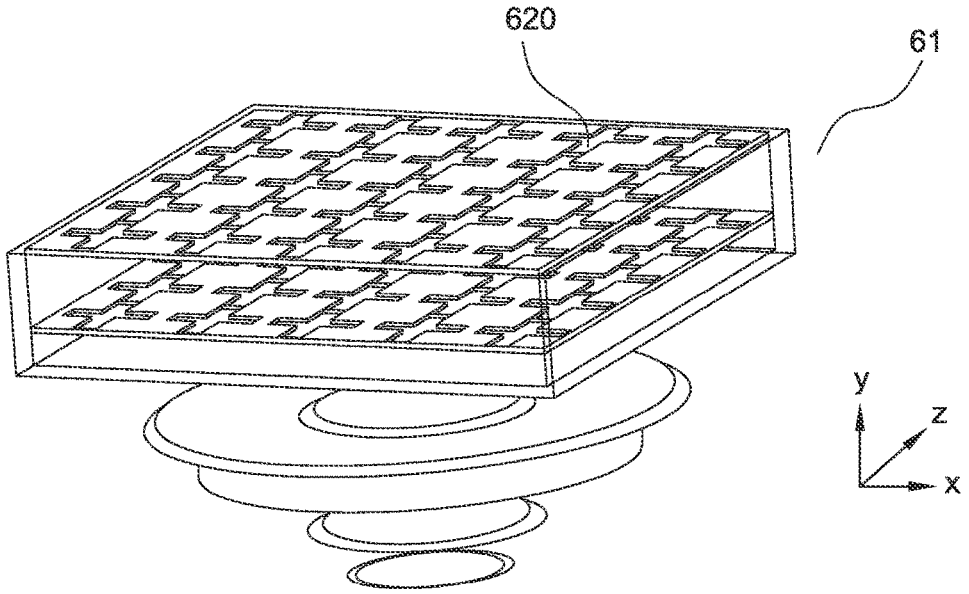

It is advantageously possible to resort to a polarizing radome which is not directly integrated into the upper cavity, as in the exemplary embodiment described hereinabove with reference to FIG. 5. FIGS. 6*a* and 6*b* present a radiating element according to another exemplary embodiment of the invention, respectively in a lateral sectional view, and in a perspective view.

In the example illustrated by FIGS. 6*a* and 6*b*, a radiating element 60 can exhibit a structure essentially similar to the structure of the radiating element 50 described hereinabove with reference to FIG. 5. Thus, the radiating element 60 comprises notably an upper cavity 31 and a lower cavity 32 fed by a waveguide 33. The upper cavity 31 is in this example covered by a cap formed by a grid 313. Corrugations 300 are produced substantially below the upper cavity 31. In the example illustrated by FIGS. 6*a* and 6*b*, the lateral walls of the upper and lower cavities 31, 32 are of cylindrical shape, with circular cross section. A polarizing radome 61 is produced above the upper cavity 31. In this example, the polarizing radome 61 is also of cylindrical shape, but with square cross section. As is illustrated by FIG. 6*b*, the polarizing radome 61 is delimited in its lateral part by lateral walls of substantially cylindrical shape, with square cross section. The use of a square cross section makes it possible here to dispose a larger number of cross-slot cells 620 of square shape on the surface of polarizing FSSs 611, 612 formed by two metallic plates disposed parallel to one another.

In a typical example, it is possible to produce a radiating element intended to operate in a frequency band stretching from 2.48 GHz to 2.5 GHz, whose polarizing radome 61 is of square shape whose side has a length of the order of $2.7\times\lambda_0$. Such a configuration makes it possible to achieve the dual circular polarization, that is to say right and left, by exciting the antenna by two linear polarizations +45° to −45°. In the two cases, the radiation patterns are perfectly axisymmetric, that is to say the width of the lobe is constant whatever the observation plane, and also characterized by a sidelobe level or SLL of less than −25 dB. Furthermore, over the frequency band mentioned above, for the two polarizations, the directivity varies between 16.5 dB and 16.7 dB, and the surface effectiveness is between 63% and 66%. The reflection coefficient $|S_{11}|$ is less than −20 dB and the axial ratio less than 1 dB over the band of interest.

Figure 7:
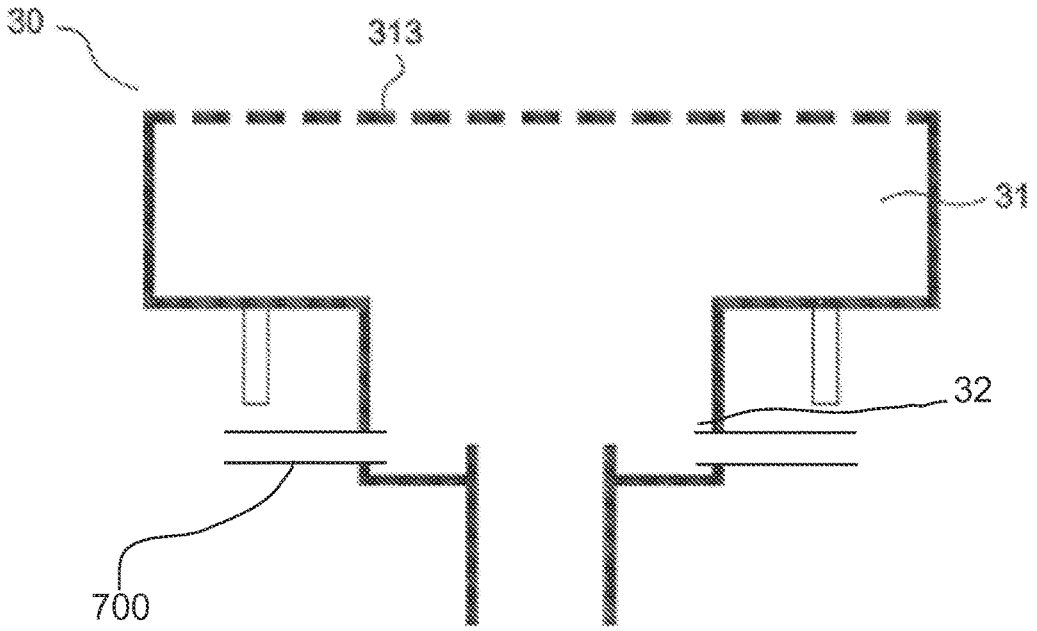
FIG. 7, illustrates a lateral sectional view of a radiating element according to another exemplary embodiment of the invention.

FIG. 4 presents a radiating element according to another exemplary embodiment of the invention, in a lateral sectional view. In the exemplary embodiment illustrated by FIG. 7, a radiating element 30 may be produced according to a structure identical to the structure described hereinabove with reference to FIGS. 3*a* and 3*b*, but in which the lower cavity 32 does not comprise any cap. A radiating element structure such as this comprises only a single grid 313. Further, the radiating element 30 is provided with a duel feed formed by two lateral waveguides 700 emerging in a symmetric manner with respect to a main axis of a lower cavity 32, substantially at a level of a lateral wall of the lower cavity 32.

The invention claimed is:

1. A radiating element comprising:

at least two concentric resonant cavities formed by a lower cavity fed by excitation means, and an upper cavity stacked on the lower cavity, each of said resonant cavities being delimited in a respective lower part by a respective earth plane, in a respective lateral part by a respective cylindrical lateral wall, at least the upper cavity being delimited in a respective upper part by a first cap that is essentially planar;

a plurality of corrugations, each of the plurality of corrugations being essentially of cylindrical shape and concentric with the cylindrical lateral wall of the lower cavity, are formed substantially below the first earth plane of the upper resonant cavity; and wherein the earth planes, the lateral walls, and the corrugations are made of a metallic material.

2. The radiating element as claimed in claim 1, wherein the lower cavity is also delimited in a respective upper part, substantially at the level of the lower part of the upper cavity, by a second cap.

3. The radiating element as claimed in claim 2, wherein the first cap and the second cap are made of a metallic material.

4. The radiating element as claimed in claim 2, wherein the first cap and the second cap are formed by a partially reflecting surface.

5. The radiating element as claimed in claim 2, wherein the first cap and the second cap are formed by a metallic grid.

6. The radiating element as claimed in claim 2, wherein the first cap and the second cap are formed by a dielectric material.

7. The radiating element as claimed in claim 1, wherein a polarizing radome is produced in the upper part of the upper cavity.

8. The radiating element, as claimed in claim 7, wherein the polarizing radome is formed by two essentially planar frequency-selective polarizing surfaces being polarizing FSSs, disposed parallel to one another, and parallel to and substantially above said first cap.

9. The radiating element as claimed in claim 8, wherein each polarizing FSS is formed by a metallic plate comprising a plurality of slots.

10. The radiating element as claimed in claim 8, wherein each polarizing FSS is formed by a metallic plate comprising a plurality of cross-slot cells.

11. The radiating element as claimed in claim 10, wherein each polarizing FSS is formed by a metallic plate comprising a plurality of cross-slot cells is disposed according to a periodic pattern on the surface of the metallic plate.

12. The radiating element as claimed in claim 1, wherein the lateral walls and the corrugations are cylindrical with circular cross section.

13. The radiating element as claimed in claim 1, wherein said excitation means comprise at least one feed guide concentric with the resonant cavities and emerging directly, or via matching means, in the lower cavity.

14. The radiating element as claimed in claim 1, wherein said excitation means comprise at least one dual feed formed by two lateral waveguides emerging in a symmetric manner with respect to the main axis of the lower cavity, substantially at the level of the lateral wall of the lower cavity, the signals conveyed by the excitation means being tuned phase-wise in such a way that the undesirable higher modes are filtered.

15. The radiating element as claimed in claim 1, wherein said excitation means comprise at least one feed guide concentric with the resonant cavities and emerging directly, or via matching means, in the lower cavity, and at least one dual feed formed by two lateral waveguides emerging in a symmetric manner with respect to the main axis of the lower cavity, substantially at the level of the lateral wall of the lower cavity, the signals conveyed by the excitation means being tuned phase-wise in such a way that the undesirable higher modes are filtered.

16. The radiating element as claimed in claim 1, wherein a polarizing radome is produced above the upper cavity, the polarizing radome being essentially of cylindrical shape and concentric with the resonant cavities.

17. The radiating element as claimed in claim 16, wherein said polarizing radome is essentially of cylindrical shape with square cross section.

18. An array antenna comprising one or more radiating elements as claimed in claim 1.

* * * * *